United States Patent [19]

Powers

[11] 4,335,165

[45] Jun. 15, 1982

[54] SNAP TOGETHER ORNAMENT

[76] Inventor: Roy A. Powers, 18537 Arrow Hwy., Covina, Calif. 91722

[21] Appl. No.: 245,942

[22] Filed: Mar. 20, 1981

[51] Int. Cl.[3] ..... A47G 33/08

[52] U.S. Cl. ..... 428/8; 46/30; 273/160

[58] Field of Search ..... 428/7, 8, 9; 46/17, 46/30; 116/63 P; 273/160

[56] References Cited

U.S. PATENT DOCUMENTS

| | | | |
|---|---|---|---|
| 1,635,915 | 7/1927 | White | 46/17 X |
| 2,067,527 | 1/1937 | Greene | 428/8 |
| 2,616,199 | 11/1952 | Robins | 428/9 |
| 2,790,410 | 4/1957 | Wald, Jr. | 116/63 P |
| 2,977,701 | 4/1961 | Louderback | 428/8 |
| 3,728,201 | 4/1973 | Stroehmer | 428/9 |
| 3,790,175 | 2/1974 | Ragnow | 428/8 X |
| 4,192,903 | 3/1980 | Tremblay | 428/8 |

*Primary Examiner*—Henry F. Epstein
*Attorney, Agent, or Firm*—C. Peter Anderson

[57] ABSTRACT

A snap-together, three-dimensional decorative ornament comprising of three interconnected, substantially planar sheets possessing a defined ornamental outline, such as a snowflake or the like, said sheet being adapted to provide peripheral and central interlocking.

5 Claims, 6 Drawing Figures

SNAP TOGETHER ORNAMENT

BACKGROUND OF THE INVENTION

This invention relates to ornaments and more particularly to a three-dimensional snap-together ornament assemblage of substantially planar sheets, each sheet consisting of a decorative motif or design.

DESCRIPTION OF THE PRIOR ART

Composite ornaments for use as Christmas tree decorations and the like are well known in the prior art. Generally such composite ornaments, as disclosed by U.S. Pat. No. 4,192,903, Tremblay, are composed of flat sheets interconnected with each other along a common juncture line, such that the sheets radiate outward there from forming a composite three-dimensional ornament. The sheets from which the ornament is constructed are normally interconnected by way of tongues and slots in the sheets thereby allowing rapid assembly and disassembly of the ornament for case of shipping and/or storage as shown in U.S. Pat. Nos. 2,067,527, Greene; 2,616,199, Robbins; 2,977,701, Louderbeck; and 3,728,201, Stroehmer.

The composite ornaments disclosed by the prior art have the disadvantages of not being easily interconnected to form a rigid yet resilient three-dimensional configuration that can withstand handling as well as repeated assembly and disassembly. The present invention overcomes the disadvantages found in the prior art in that it provides a composite ornament composed of interlocking sheets that can be shipped disassembled to minimize breakage, yet assembled rapidly to form a rigid three-dimensional configuration resilient enough to withstand repeated assembly and disassembly.

SUMMARY OF THE INVENTION

The invention comprises three substantially flat sheets of material, each of said sheets possessing a defined ornamental outline, such as a snowflake, circular, rectangular or other shape, as a variety of shapes can be utilized without departing from the scope of the invention.

The first of said planar sheets having an X-shaped opening and four opposed peripheral notches, each located opposite the ends of said X-shaped opening. The second sheet having an elongate slot and a pair of opposed peripheral notches on a line perpendicular to and bisecting the axis of the elongate slot. The elongate slot is adapted to receive the first planar sheet or member such that the second sheet or member upon intersection with the first member snaps into position substantially at right angles to the first member, with the ends of the elongate slot of the second member engaging a pair of the opposed peripheral notches of the first member. The third planar member has a centered X-shaped opening adapted to receive the assembled first and second members. The interlocked first and second members are inserted into the X-shaped opening in the third member with the ends of the X-shaped opening of the third member snapping or locking into a pair of peripheral notches located on the first and second sheets respectively. The three interlocked members form a three-dimensional rigid, interlocking structure consisting of three-planar members positioned in an orthogonal relationship.

It is accordingly a primary object of this invention to provide a composite ornament including three substantially planar sheets adapted to be shipped flat and then easily assembled in interlocking position to form a rigid, resilient, three-dimensional structure.

It is another object of the invention to provide a composite ornament of three intersecting planar members where each member possesses a different ornamental outline or design.

A further object of the invention is to provide a composite ornament having three intersecting planar members which intersect in an orthogonal relationship.

A still further object of the invention is to provide a composite ornament which may be made in a wide variety of shapes and designs that is simple in construction and inexpensive to manufacture.

Other objects, characteristics and advantages of the invention will be more readily apparent as the detailed thereof proceeds when considered in connection with the accompanying illustrative drawings.

DESCRIPTION OF THE DRAWINGS

Referring more particularly to the accompanying drawings, which are for illustrative purposes only.

DESCRIPTION OF THE PREFERRED EMBODIMENT

Figure 1:
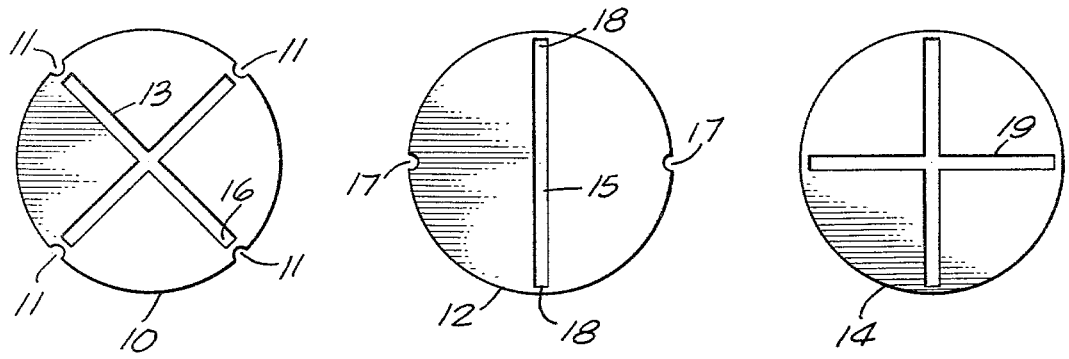
FIG. 1 is a plan view of the three members 10, 12 and 14 of the invention shown unassembled.

Referring to the drawings and more particularly to FIG. 1 which shows the ornament of the present invention unassembled and consisting of planar members 10, 12 and 14. The members 10, 12 and 14 as shown in FIG. 1 have a disc shape for illustrative purposes only as many configurations are possible as shown for example in FIGS. 5 and 6.

Member 10 possesses a centered equidimensional X-shaped opening 13 with four opposed peripheral notches 11 located opposite the ends 16 of the X-shaped opening 13.

Again referring to FIG. 1, member 12 has an elongate slot 15 and pair of opposed peripheral notches 17 locked along a line perpendicular to and bisecting the axis of slot 15.

Figure 2:
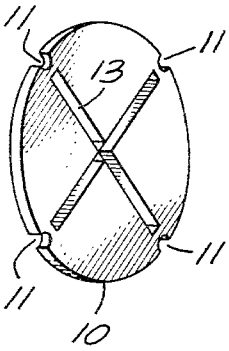
FIG. 2 is a perspective view of member 10.
Figure 3:
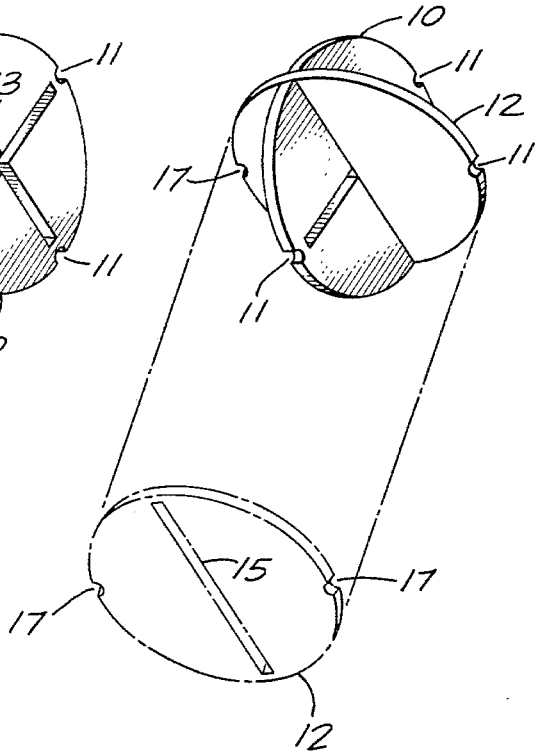
FIG. 3 is a perspective view of the invention partially assembled showing the interconnection of member 12 with member 10.

Elongate slot 15 of member 12 is adapted to receive member 10 such that member 10 upon insertion into slot 15 of member 12 "locks" into position substantially at right angles to member 12 as shown in FIG. 3. The X-shaped slot 13 of member 10 as shown in FIGS. 1 and 2 permits member 10 to temporarily deform inward thereby allowing member 12 to "snap" or lock into place by forcing the ends 18 of slot 15 to engage two of the peripheral notches 11 on member 10 as demonstrated in FIG. 3.

Figure 4:
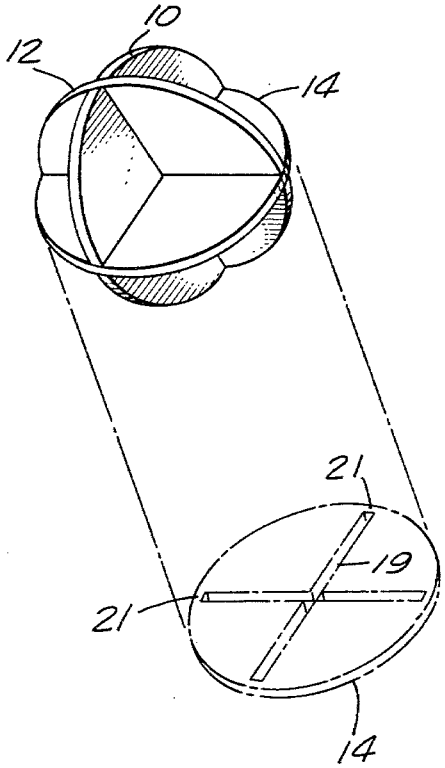
FIG. 4 is a perspective view of the assembled invention showing the interconnection of members 10, 12 and 14.

Referring again to FIG. 1, member 14 possesses a centered X-shaped opening 19 adapted to receive the partially assembled ornament consisting of interlocked members 10 and 12 as shown in FIG. 3. As shown by FIG. 4, to complete the ornament of the present invention, the partially assembled ornament, consisting of interlocked members 10 and 12 is inserted into the X-shaped opening 19 of member 14.

Member 14 locks into place forcing the distal ends 21 of X-shaped opening 19 to engage the remaining pair of notches 11 in member 10 and the pair of notches 17 in member 12. Member 14 snaps or locks into position substantially at right angles to both member 10 and member 12 forming the completed ornament as shown in FIG. 4.

Figure 5:
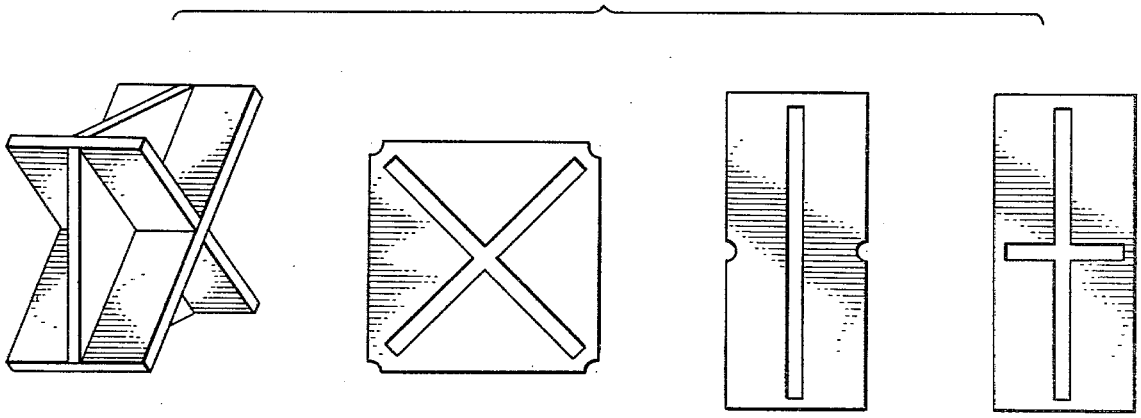
FIG. 5 is a perspective view of an alternate embodiment of the assembled invention and the undivided constituent members.
Figure 6:
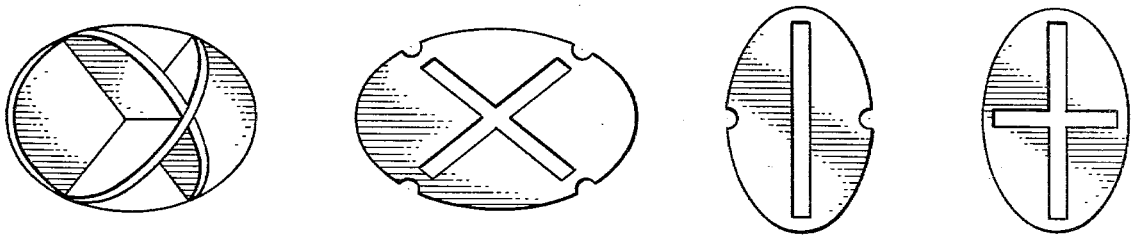
FIG. 6 is a perspective view of another embodiment and the individual constituent members.

As shown in FIGS. 5 and 6, the shape and size of the planar members and their respective slot openings may be varied to produce a number of different shapes and angular configurations.

In order that the members 10, 12 and 14 snap or lock together to form a rigid structure, the inside dimensions between pairs peripheral notches on members 10 and 12 are such that they are slightly greater than the length dimension of the corresponding slots which lockingly engage the peripheral notches. For example, the distance between opposite peripheral notches 11 on member 10 must be equal to or greater than the length of elongate slot 15 of member 12 so that upon insertion of member 10 into slot 15 of member 12, member 10 flexes inward allowing the ends 18 of slot 15 to lockingly engage peripheral notches 11. The resultant interlocking assemblage of members 10, 12 and 14 provides a rigid three-dimensional structure that can be easily assembled and disassembled and allows combination of a number of different shaped members to produce a variety of ornaments of differring configurations.

Although several examplary embodiments of the invention have been disclosed and described, it will be understood that other applications of the invention are possible and that the embodiments disclosed may be subject to various changes, modifications and substitutions without necessarily departing from the spirit of the invention.

I claim:

1. An ornamental structure comprising:

a. A first planar member having a centered opening, said opening being adapted to allow said member to temporarily spring inward and four (4) equally angularly spaced peripheral notches;

b. A second planar member having a centrally disposed elongate slot adapted to receive said first member and a pair of opposed peripheral notches on a line perpendicular to and bisecting the axis of said elongate slot, such that upon insertion of said first member into said elongate slot, the distal ends of said elongate slot lockingly engage a pair of said peripheral notches on said first member to secure said first and said second member together in intersecting, interlocking relationship;

c. A third planar member having a centered X-shaped opening adapted to receive said intersected, interlocked first and second members such that upon insertion of said intersected, interlocked first and second members into said X-shaped opening the distal ends of said X-shaped opening lockingly engage said pair of opposed peripheral notches on said second member and the remaining pair of said opposed peripheral notches on said first member to secure said first, second and third members in a rigid intersectioning relationship.

2. The ornament of claim 1 in which said members intersect in a mutually orthogonal relationship.

3. The ornament of claim 1 in which all of said members are of identical shape.

4. An ornamental structure comprising:

a. A first planar member having two (2) pair of opposed peripheral notches equally spaced apart on said member;

b. A second planar member having a centrally disposed elongate slot adapted to receive said first member and a pair of opposed peripheral notches on a line perpendicular to and bisecting the axis of said elongate slot, such that upon insertion of said first member into said elongate slot the distal ends of said elongate slot lockingly engage a pair of said peripheral notches on said first member, to secure said first and said second members together in intersecting, interlocking relationship;

c. A third planar member having a centered X-shaped opening adapted to receive said intersected, interlocked first and second members such that upon insertion of said intersected, interlocked first and second member into said X-shaped opening the distal ends of said X-shaped opening lockingly engage said pair of opposed peripheral notches on said second member and the remaining pair of said opposed peripheral notches on said first member to secure said first, second and third members in a rigid intersecting relationship.

5. The ornament of claim 4 in which the distance between said opposed peripheral notches on said first and second member is greater than the length dimension of said elongate slot of said second member and said X-shaped slot of said third member.

* * * * *